US012213521B2

(12) United States Patent
Jeoung

(10) Patent No.: US 12,213,521 B2
(45) Date of Patent: Feb. 4, 2025

(54) AEROSOL GENERATING ARTICLE AND AEROSOL GENERATING DEVICE FOR HEATING THE SAME

(71) Applicant: KT&G CORPORATION, Daejeon (KR)

(72) Inventor: Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 0 days.

(21) Appl. No.: 17/640,940

(22) PCT Filed: Oct. 15, 2021

(86) PCT No.: PCT/KR2021/014366
§ 371 (c)(1),
(2) Date: Mar. 7, 2022

(87) PCT Pub. No.: WO2022/080952
PCT Pub. Date: Apr. 21, 2022

(65) Prior Publication Data

US 2024/0041108 A1 Feb. 8, 2024

(30) Foreign Application Priority Data

Oct. 16, 2020 (KR) ..... 10-2020-0134642

(51) Int. Cl.
*A24F 40/42* (2020.01)
*A24F 40/20* (2020.01)
*A24F 40/48* (2020.01)

(52) U.S. Cl.
CPC ..... *A24F 40/42* (2020.01); *A24F 40/20* (2020.01); *A24F 40/48* (2020.01)

(58) Field of Classification Search
CPC ..... A24F 40/42; A24F 40/48; A24F 40/20; A24F 40/40
USPC ..... 131/129
See application file for complete search history.

(56) References Cited

U.S. PATENT DOCUMENTS

| | | | |
|---|---|---|---|
| 10,219,537 | B2 | 3/2019 | Mua et al. |
| 10,219,548 | B2 | 3/2019 | Robinson et al. |
| 10,856,573 | B2 | 12/2020 | Pijnenburg et al. |
| 11,026,449 | B2 | 6/2021 | Mironov |

(Continued)

FOREIGN PATENT DOCUMENTS

| | | | |
|---|---|---|---|
| CN | 201192067 | Y | 2/2009 |
| JP | 2018-166509 | A | 11/2018 |

(Continued)

OTHER PUBLICATIONS

International Search Report of PCT/KR2021/014366 dated Jan. 24, 2022 [PCT/ISA/210].

(Continued)

*Primary Examiner* — Harshad C Patel
(74) *Attorney, Agent, or Firm* — Sughrue Mion, PLLC

(57) ABSTRACT

An aerosol generating article includes: a tobacco element; and a pouch configured to wrap the tobacco element, and discharge, to the outside, an aerosol generated by the aerosol generating article being heated, wherein the pouch is impregnated with a moisturizer of about 10 parts by weight to about 30 parts by weight with respect to 100 parts by weight of the tobacco element.

14 Claims, 11 Drawing Sheets

(56) References Cited

U.S. PATENT DOCUMENTS

| | | | | |
|---|---|---|---|---|
| 2015/0107610 | A1* | 4/2015 | Metrangolo | A24D 1/20 131/335 |
| 2016/0022930 | A1* | 1/2016 | Greim | A61M 15/0003 131/328 |
| 2017/0119048 | A1 | 5/2017 | Kaufman et al. | |
| 2017/0360088 | A1* | 12/2017 | Pijnenburg | A24F 40/53 |
| 2018/0000157 | A1* | 1/2018 | Batista | A24F 40/40 |
| 2018/0084831 | A1 | 3/2018 | Mironov | |
| 2018/0295882 | A1* | 10/2018 | Ricketts | A24F 40/42 |
| 2018/0317554 | A1 | 11/2018 | Kaufman et al. | |
| 2018/0343920 | A1 | 12/2018 | Sutton et al. | |
| 2020/0039733 | A1* | 2/2020 | Rodrigues | B65D 5/662 |
| 2020/0121670 | A1 | 4/2020 | Rogers et al. | |
| 2020/0138098 | A1 | 5/2020 | Mironov et al. | |
| 2021/0100285 | A1 | 4/2021 | Spencer et al. | |

FOREIGN PATENT DOCUMENTS

| | | | |
|---|---|---|---|
| JP | 2020-62037 | A | 4/2020 |
| KR | 10-1647936 | B1 | 8/2016 |
| KR | 10-2017-0094144 | A | 8/2017 |
| KR | 10-2017-0134376 | A | 12/2017 |
| KR | 10-2020-0098676 | A | 8/2020 |
| WO | 2016/162446 | A1 | 10/2016 |

OTHER PUBLICATIONS

Extended European Search Report dated Aug. 23, 2022 issued in European Application No. 21859364.8.
Office Action issued Mar. 7, 2023 in Japanese Application No. 2022-513297.

* cited by examiner

AEROSOL GENERATING ARTICLE AND AEROSOL GENERATING DEVICE FOR HEATING THE SAME

CROSS REFERENCE TO RELATED APPLICATIONS

This application is a National Stage of International Application No. PCT/KR2021/014366 filed on Oct. 15, 2021, claiming priority based on Korean Patent Application No. 10-2020-0134642 filed on Oct. 16, 2020.

TECHNICAL FIELD

Various embodiments of the present disclosure relate to an aerosol generating article and an aerosol generating device for heating the same, and more particularly, to an aerosol generating article in which a medium for generating an aerosol is put in a pouch, and an aerosol generating device for heating the same.

BACKGROUND ART

Recently, the demand for alternative methods to overcome the disadvantages of traditional cigarettes has increased. For example, there is growing demand for an aerosol generating device which generates aerosol by heating an aerosol generating material, rather than by combusting cigarettes. Accordingly, researches on a heating-type aerosol generating device has been actively conducted.

In an example, a heating-type aerosol generating device may generate an aerosol by accommodating, in an accommodation portion, a tobacco material such as tobacco leaves, a tobacco cut filler, or a processed tobacco product (e.g., granules or a reconstituted tobacco sheet), and heating the tobacco material accommodated in the accommodation portion.

DESCRIPTION OF EMBODIMENTS

Technical Problem

A heating-type aerosol generating device that generates an aerosol by heating a tobacco material accommodated in an accommodation portion may not easily accommodate a certain amount of tobacco material in the accommodation portion, may need a process of accommodating the tobacco material in the accommodation portion and then cutting the tobacco material into pieces, and accordingly, may be inconvenient for use.

In addition, as the heating-type aerosol generating device described above may generate an aerosol by heating a tobacco material having a low moisture content, an amount of smoke may be insufficient, and accordingly, a user's smoking satisfaction may be low.

Accordingly, the present disclosure provides an aerosol generating article that may secure the convenience of a smoking process and generate a sufficient amount of smoke, and an aerosol generating device for heating the same.

The problem to be solved by the present disclosure is not limited to the above-described problem, and problems that are not mentioned will be clearly understood by those of ordinary skill in the art from the present specification and the accompanying drawings.

Solution to Problem

An aerosol generating article according to an embodiment of the present disclosure includes a tobacco element, and a pouch configured to wrap the tobacco element, and discharge, to the outside, an aerosol generated by the aerosol generating article being heated, wherein the pouch is impregnated with a moisturizer of about 10 parts by weight to about 30 parts by weight with respect to 100 parts by weight of the tobacco element.

An aerosol generating device for heating an aerosol generating article, according to an embodiment of the present disclosure, includes an accommodation portion in which at least one region of an aerosol generating article described above is accommodated, and a heater configured to heat the aerosol generating article accommodated in the accommodation portion.

Advantageous Effects of Disclosure

An aerosol generating article according to various embodiments of the present disclosure may provide a user with smoking convenience and a sufficient amount of smoke.

Also, the aerosol generating article according to various embodiments of the present disclosure may increase smoking hygiene via a mouthpiece attached to a pouch.

The effects of the embodiments are not limited to the above-described effects, and effects that are not mentioned will be clearly understood by those of ordinary skill in the art from the present disclosure and the accompanying drawings.

MODE OF DISCLOSURE

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and may be implemented by hardware components or software components and combinations thereof.

Also, in the present disclosure, an "aerosol generating device" may be a device that generates an aerosol by using an aerosol generating material to generate an aerosol that may be directly inhaled into a user's lungs through the user's mouth.

Moreover, in the present disclosure, a "tobacco element" refers to an element including a tobacco material, and the "tobacco material" refers to any form of material including ingredients derived from tobacco leaves.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Throughout the specification, "embodiments" are certain classifications for easily describing the invention in the present disclosure, and the embodiments do not need to be mutually exclusive. For example, components disclosed in an embodiment may be applied to and/or implemented in the other embodiments, and may be changed and applied and/or implemented without departing from the scope of the present disclosure.

In addition, the terms used in the present disclosure are intended to explain embodiments and are not intended to limit the embodiments. In the present disclosure, the singular forms are intended to include the plural forms as well, unless the context clearly indicates otherwise.

Figure 1:
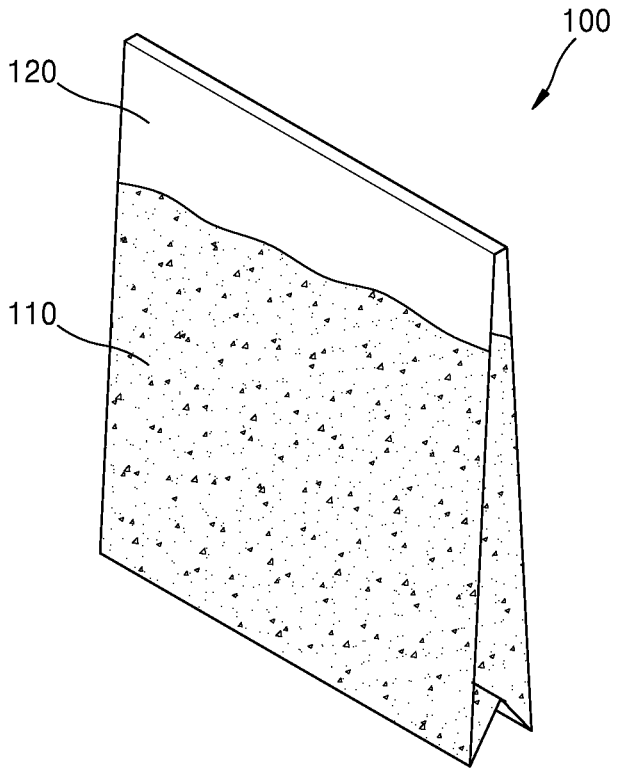
FIG. 1 is a perspective view of an aerosol generating article according to an embodiment.

FIG. 1 is a perspective view of an aerosol generating article according to an embodiment.

Referring to FIG. 1, an aerosol generating article 100 according to an embodiment includes a tobacco element 110, and a pouch 120 wrapping the tobacco element 110.

The tobacco element 110 may be accommodated inside the pouch 120, and the tobacco element 110 described above may be a certain type of tobacco material.

For example, the tobacco element 110 may be a tobacco material in the form of a tobacco cut filler, tobacco particles, a tobacco sheet, tobacco beads, tobacco granules, or tobacco extract, but is not limited thereto.

Also, the tobacco element 110 may include one or more kinds from among tobacco leaves, tobacco leaf veins, expanded tobacco, cut filler, a reconstituted tobacco sheet, and reconstituted tobacco.

In an embodiment, the tobacco element 110 may include any one of additives such as flavors, a wetting agent, and/or organic acid, and a flavoring material, or further a mixture thereof.

Also, the tobacco element 110 may further include at least one of plant extract, spices, and a vitamin mixture. The spices of a medium may include menthol, peppermint, spearmint oil, and various fruit-flavored ingredients, but are not limited thereto. The vitamin mixture of the medium may be a mixture of at least one of vitamin A, vitamin B, vitamin C, and vitamin E, but is not limited thereto.

The pouch 120 may wrap the tobacco element 110, and accordingly, the tobacco element 110 may be accommodated inside the pouch 120. In other words, the pouch 120 may be a kind of package accommodating the tobacco element 110.

In an embodiment, the pouch 120 may be impregnated with a moisturizer. The moisturizer impregnated in the pouch 120 may include, for example, at least one of glycerin, propylene glycol, ethylene glycol, dipropylene glycol, diethylene glycol, triethylene glycol, tetraethylene glycol, and oleyl alcohol, but is not limited thereto.

When the tobacco element 110 accommodated in the pouch 120, which is not impregnated with a moisturizer, is heated, an amount of moisture in the tobacco element 110 may be small, and thus, an amount of smoke generated by a process of heating the aerosol generating article 100 may be insufficient.

In contrast, in the aerosol generating article 100 according to an embodiment, as the pouch 120 accommodating the tobacco element 110 is impregnated with a moisturizer, a greater amount of aerosol may be atomized in a process of heating the aerosol generating article 100, thereby securing a sufficient amount of smoke.

As a result, the aerosol generating article 100 according to an embodiment may provide a user with an enhanced smoking sensation or smoking impression.

In an embodiment, the pouch 120 may be impregnated with a moisturizer of about 10 parts by weight to about 30 parts by weight with respect to 100 parts by weight of the tobacco element 110. In other words, the pouch 120 may be impregnated with a moisturizer in a mass of about 10% to about 30% of a mass of the tobacco element 110.

For example, when the pouch 120 is impregnated with a moisturizer in an amount or mass less than about 10 parts by weight with respect to 100 parts by weight of the tobacco element 110, a sufficient amount of aerosol may not be generated by a process of heating the aerosol generating article 100.

As another example, when the pouch 120 is impregnated with a moisturizer in an amount or mass greater than about 30 parts by weight with respect to 100 parts by weight of the tobacco element 110, the user's hand holding the aerosol generating article 100 may be stained with the moisturizer, thereby causing discomfort to the user.

In other words, as the pouch 120 of the aerosol generating article 100 according to an embodiment is impregnated with a moisturizer of about 10 parts by weight to about 30 parts by weight with respect to 100 parts by weight of the tobacco element 110, a sufficient amount of smoke may be secured while the user's discomfort is made least.

In an embodiment, the pouch 120 may be formed of a porous material. The porous material may include, for example, a cellulose material, but is not limited thereto.

As the pouch 120 is formed of the porous material, air outside the aerosol generating article 100 may be introduced into the aerosol generating article 100, or an aerosol generated inside the aerosol generating article 100 may be discharged to the outside.

For example, in a process of heating the aerosol generating article 100, high-temperature external air may be introduced into the pouch 120 and heat the tobacco element 110.

Figure 2:
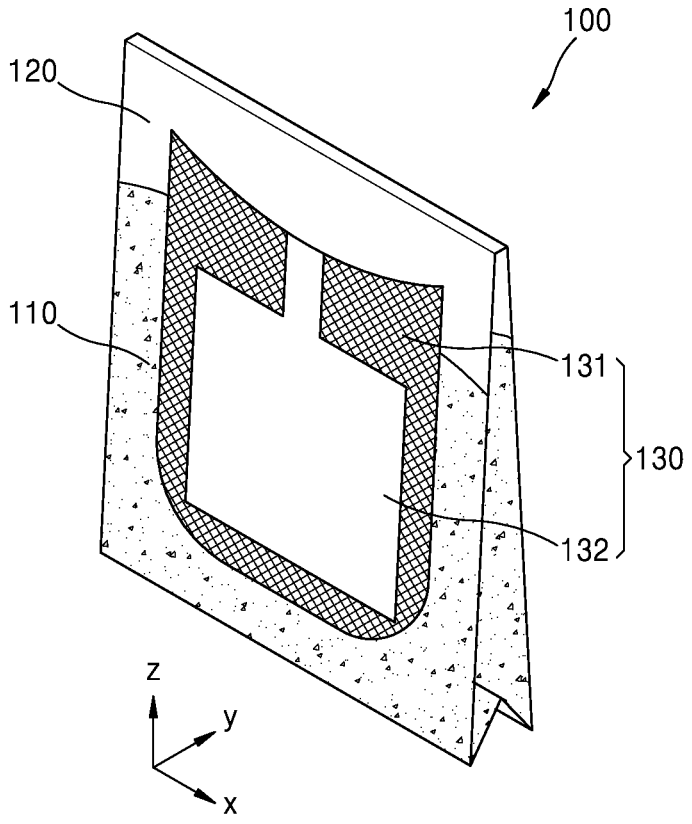
FIG. 2 is a perspective view of an aerosol generating article according to another embodiment.

FIG. 2 is a perspective view of an aerosol generating article according to another embodiment.

Referring to FIG. 2, an aerosol generating article 100 according to another embodiment may include a tobacco element 110, a pouch 120, and a mouthpiece portion 130.

The aerosol generating article 100 according to another embodiment may be an aerosol generating article 100 obtained by adding the mouthpiece portion 130 to the aerosol generating article 100 of FIG. 1, and thus, a repeated description thereof will be omitted herein.

The mouthpiece portion 130 may be coupled to at least one region of the pouch 120 to be repositionable or foldable, and may operate as a mouthpiece for supplying a user with an aerosol generated by the aerosol generating article 100. For example, the mouthpiece portion 130 may be attached to at least one region of the pouch 120, but is not limited thereto.

In an embodiment, the mouthpiece portion 130 may include an attachment segment 131 that is attached to at least one region of the pouch 120, and a mouthpiece segment 132 that is foldable with respect to the pouch 120.

The attachment segment 131 may be attached to at least one region of the pouch 120 via an adhesive member (not shown), and thus couple or connect the mouthpiece portion 130 to the pouch 120. Here, the adhesive member may include at least one of an adhesive tape, an adhesive, and an adhesive layer, but is not limited thereto.

The mouthpiece segment 132 may be connected or coupled to be foldable or pivotable with respect to the pouch 120, and may be transformed in shape to form a flow passage through which an aerosol generated by the aerosol generating article 100 flows. However, a process of transforming the shape of the mouthpiece segment 132 to form the flow passage will be described later.

In an embodiment, the mouthpiece portion 130 may include a material having a certain rigidity while being transformable in shape to form a flow passage. Here, the certain rigidity may refer to a rigidity capable of maintaining a transformed shape.

Also, the mouthpiece portion 130 may include a material having a low thermal conductivity so that high-temperature heat generated during a process of heating the aerosol generating article 100 may not be transmitted to a user.

For example, the mouthpiece portion 130 may include a paper material having a certain rigidity and a low thermal conductivity, but the material of the mouthpiece portion 130 is not limited thereto.

Also, the shape of the attachment segment 131 and/or the mouthpiece segment 132 of the mouthpiece portion 130 illustrated in FIG. 2 is an example of the present disclosure, and the shape of the attachment segment 131 and/or the mouthpiece segment 132 is not limited to the illustrated shape.

Hereinafter, a process in which the mouthpiece segment 132 of the mouthpiece portion 130 forms a flow passage through which an aerosol may flow will be described in detail with reference to FIGS. 3A, 3B, and 3C.

Figure 3A:
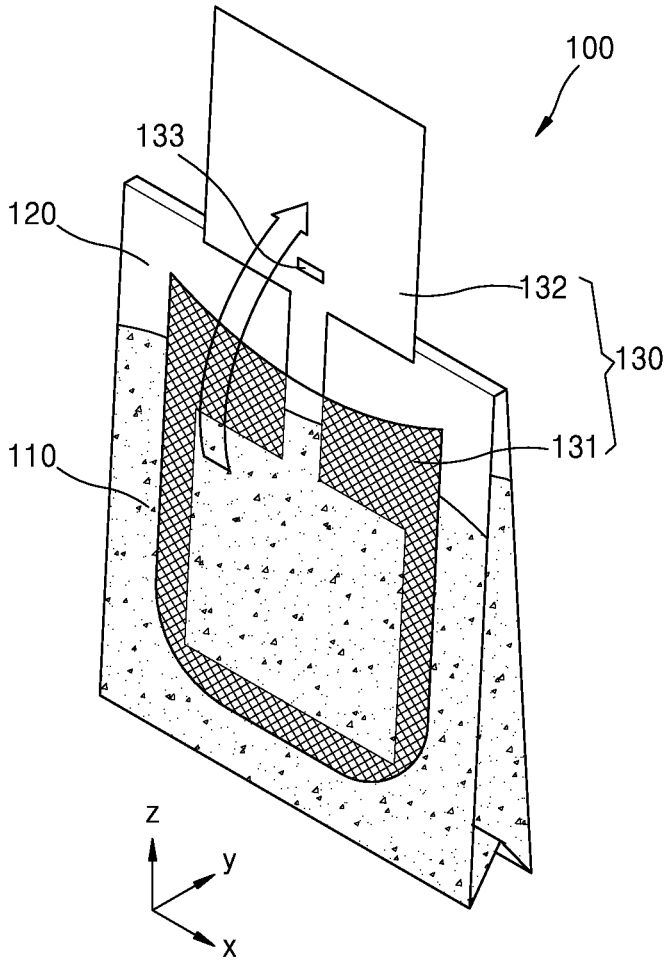
FIG. 3A is a view for explaining a process in which a mouthpiece segment of the aerosol generating article of FIG. 2 pivots.

FIG. 3A is a view for explaining a process in which a mouthpiece segment of an aerosol generating article of FIG. 2 pivots. FIG. 3B is a view for explaining a process in which the mouthpiece segment of the aerosol generating article of FIG. 2 is transformed. FIG. 3C is a view illustrating the mouthpiece segment of the aerosol generating article of FIG. 2 which is transformed.

Figure 3B:
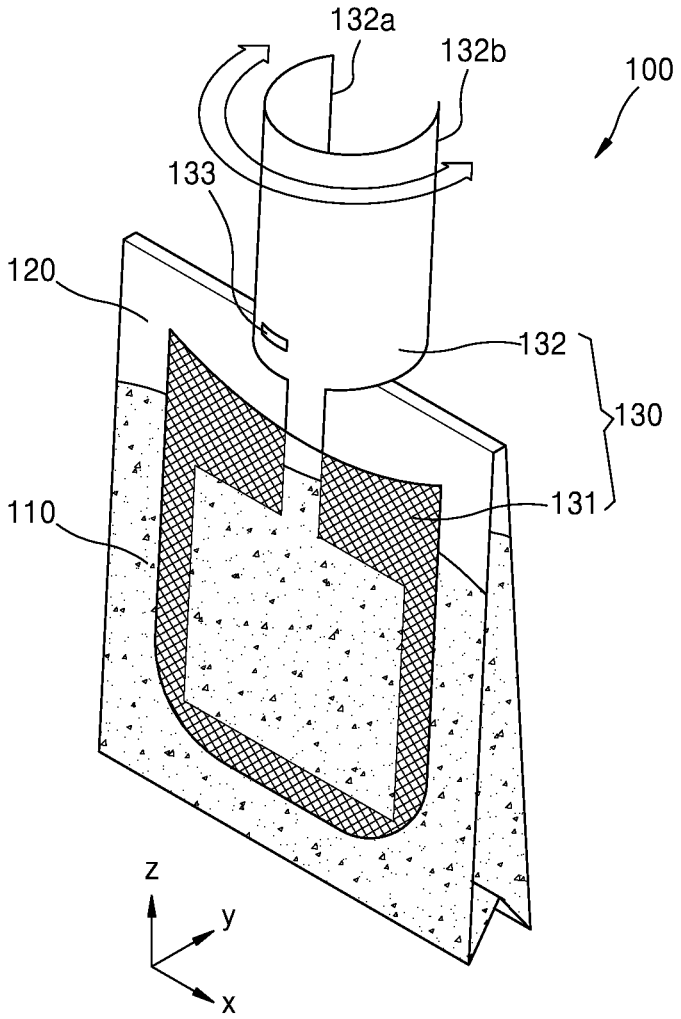
FIG. 3B is a view for explaining a process in which the mouthpiece segment of the aerosol generating article of FIG. 2 is transformed.
Figure 3C:
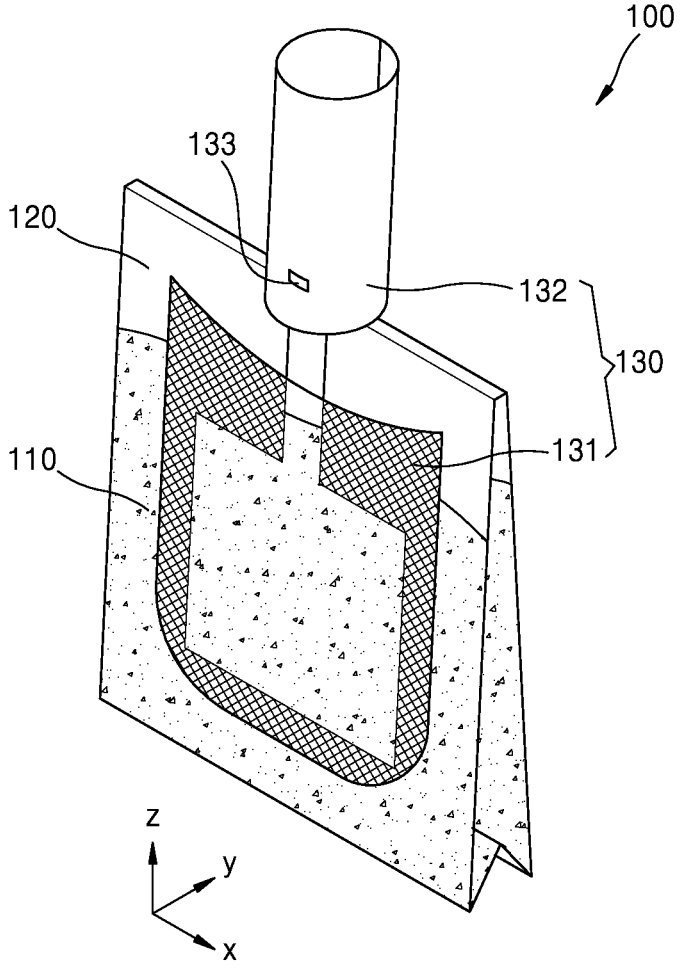
FIG. 3C is a view illustrating the mouthpiece segment of the aerosol generating article of FIG. 2 that is transformed.

At least one of components of an aerosol generating article 100 illustrated in FIGS. 3A through 3C may be the same as or similar to at least one of the components of the aerosol generating article 100 of FIG. 2, and thus, a repeated description thereof will be omitted herein.

Referring to FIG. 3A, a mouthpiece segment 132 of an aerosol generating article 100 according to an embodiment may be folded in a direction away from an attachment segment 131 at a location where one end portion thereof is in contact with the attachment segment 131.

For example, the mouthpiece segment 132 may be folded toward an upper end of a pouch 120 (e.g., in a z direction of FIG. 3A) while in contact with one region of the pouch 120. Accordingly, a user may fold up the mouthpiece segment 132 in a smoking process to pivot the mouthpiece segment 132 toward the upper end of the pouch 120.

Referring to FIGS. 3B and 3C, the mouthpiece segment 132 moved toward the upper end of the pouch 120 may be transformed in shape to form a flow passage through which an aerosol generated by the aerosol generating article 100 may flow.

In an embodiment, the mouthpiece segment 132 may be rolled while being unfolded, such that one end (or one edge) 132*a* faces the other end (or the other edge) 132*b* facing the opposite direction to the one end 132*a*, and form a flow passage through which an aerosol may flow.

For example, the mouthpiece segment 132 may be rolled in a circular or elliptical shape to form a cylindrical or elliptical columnar flow passage, but the shape of the flow passage is not limited thereto. In one or more embodiments, the flow passage may also be formed in a polygonal (e.g., a triangular or a rectangular) columnar shape.

The user may contact the mouth with the mouthpiece segment 132, and inhale, through the flow passage formed by the mouthpiece segment 132, an aerosol discharged to the outside of the aerosol generating article 100.

Although not shown in FIGS. 3A through 3C, according to another embodiment, at least a portion of the mouthpiece segment 132 may be bent to form a flow passage through which an aerosol generated by the aerosol generating article 100 may flow. For example, the mouthpiece segment 132 may be folded or rolled into a certain shape to form a flow passage, but is not limited thereto.

According to an embodiment, the mouthpiece segment 132 may further include at least one opening 133 through which air may pass.

The at least one opening 133 may be formed in at least one region of the mouthpiece segment 132. For example, the at least one opening 133 may include at least one of a hole and a slit formed in at least one region of the mouthpiece segment 132. However, according to one or more embodiments, the at least one opening 133 may also be formed in other shapes through which air may pass, in addition to the shapes described above.

When the mouthpiece segment 132 is transformed to form a flow passage through which an aerosol may flow, external air may be introduced into the flow passage through the at least one opening 133.

As the external air is introduced into the flow passage, an internal temperature of the flow passage overheated in a process of heating the aerosol generating article 100 may be cooled, and the external air may be mixed with an aerosol generated by the aerosol generating article 100, thereby increasing the user's smoking sensation or smoking impression.

Figure 4:
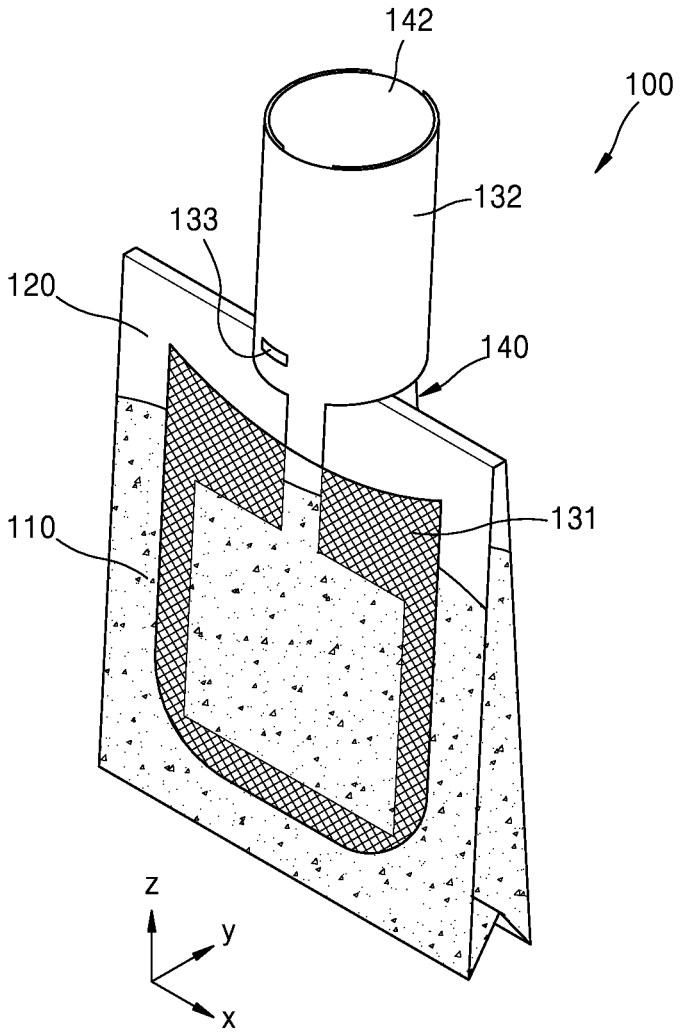
FIG. 4 is a perspective view of an aerosol generating article according to another embodiment.

FIG. 4 is a perspective view of an aerosol generating article according to another embodiment.

Referring to FIG. 4, an aerosol generating article 100 according to another embodiment may include a tobacco element 110, a pouch 120, a mouthpiece portion 130 (e.g., mouthpiece portion 130 of FIGS. 3A-3C), and a second mouthpiece portion 140.

The aerosol generating article 100 according to another embodiment may be an aerosol generating article 100 obtained by adding the second mouthpiece portion 140 to the aerosol generating article 100 of FIG. 2 or FIGS. 3A through 3C, and thus, a repeated description thereof will be omitted herein.

In the aerosol generating article 100 according to another embodiment, the shape of the mouthpiece portion 130 and the second mouthpiece portion 140 may be transformed to form a flow passage through which an aerosol generated by the aerosol generating article 100 may flow.

The mouthpiece portion 130 may include an attachment segment 131 (e.g., the attachment segment 131 of FIG. 3A) attached to at least one region of the pouch 120, and a mouthpiece segment 132 (e.g., the mouthpiece segment 132 of FIG. 3A) coupled or connected to be repositionable with respect to the pouch 120.

Similarly, the second mouthpiece portion 140 may include a second attachment segment (not shown) attached to a region of the pouch 120 that is different from the one region to which the mouthpiece portion 130 described above is attached, and a second mouthpiece segment 142 coupled or connected to be repositionable with respect to the pouch 120.

The mouthpiece segment 132 of the mouthpiece portion 130 and the second mouthpiece segment 142 of the second mouthpiece portion 140 may pivot toward an upper end of the pouch 120 (e.g., in a z direction of FIG. 4) while in contact with the pouch 120.

The mouthpiece segment 132 and the second mouthpiece segment 142 moved toward the upper end of the pouch 120 may be transformed in shape to form a flow passage through which an aerosol generated by the aerosol generating article 100 may flow.

For example, the mouthpiece segment 132 may be rolled while being unfolded, such that one end thereof faces the other end facing the opposite direction to the one end. Similarly, the mouthpiece segment 142 may also be rolled while being unfolded, such that one end thereof faces the other end facing the opposite direction to the one end.

As at least one region of the mouthpiece segment 132 that is rolled overlaps at least one region of the second mouthpiece segment 142 that is rolled, a flow passage through which an aerosol generated by the aerosol generating article 100 may flow may be formed.

The flow passage formed by the mouthpiece portion 130 and the second mouthpiece portion 140 may operate as a mouthpiece that is in contact with a user's mouth. In other words, the user may contact the mouth with the flow passage formed by the mouthpiece portion 130 and the second mouthpiece portion 140, and inhale an aerosol generated by the aerosol generating article 100.

Although not shown in in FIG. 4, according to another embodiment, at least a portion of the mouthpiece segment 132 and the second mouthpiece segment 142 may be bent to form a flow passage through which an aerosol may flow. For example, the mouthpiece segment 132 and the second mouthpiece segment 142 may be folded or rolled into a certain shape to form a flow passage, but are not limited thereto.

Figure 5:
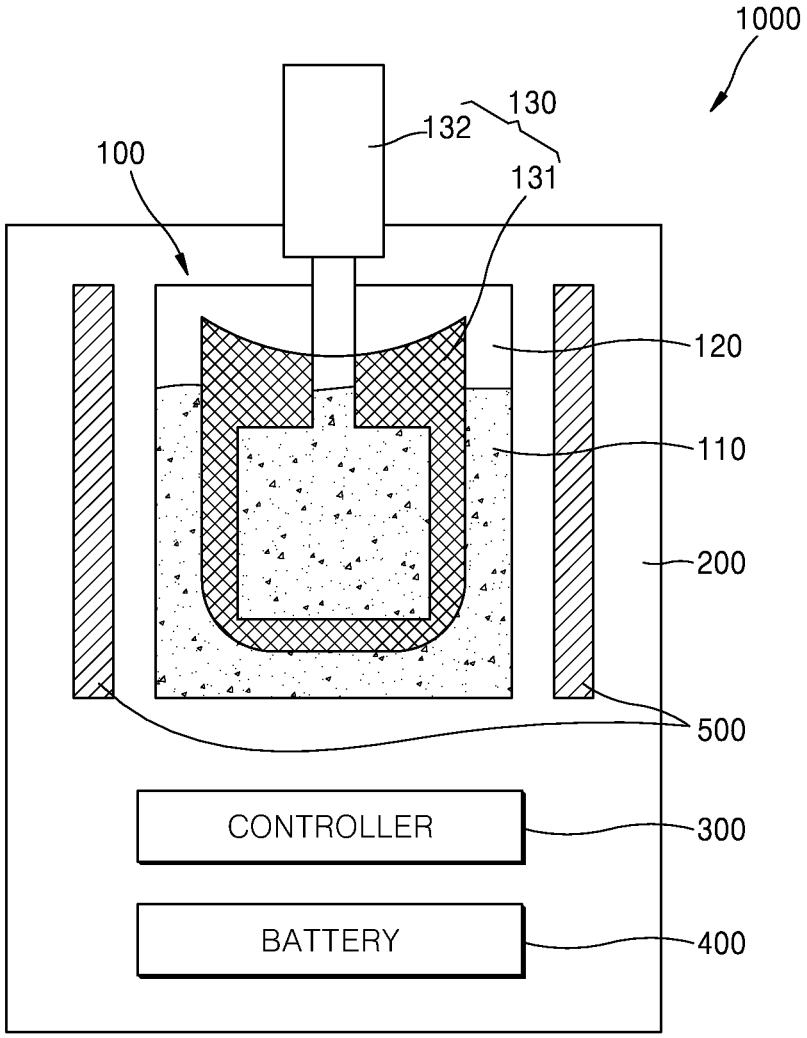
FIG. 5 is a schematic diagram illustrating components of an aerosol generating device according to an embodiment.

FIG. 5 is a schematic diagram illustrating components of an aerosol generating device according to an embodiment.

Referring to FIG. 5, an aerosol generating device 1000 according to an embodiment may include a housing 200, a controller 300, a battery 400, and a heater 500. Also, an aerosol generating article 100 may be accommodated in an inner space (or an accommodation portion) of the housing 200 of the aerosol generating device 1000.

Here, the aerosol generating article 100 may be any one of the aerosol generating articles 100 of FIGS. 1, 2, and 4, and thus, a repeated description thereof will be omitted herein.

The housing 200 may form the exterior of the aerosol generating device 1000, and may include the accommodation portion (not shown) in which the aerosol generating article 100 may be accommodated.

In addition, components for driving the aerosol generating device 1000 may be arranged inside the housing 200. For example, the housing 200 may include the controller 300, the battery 400, and/or the heater 500 arranged therein, but is not limited thereto. As another example, other components (e.g., a display and a sensor) may be additionally arranged inside the housing 200.

The controller 300 may be arranged inside the housing 200 and control overall operation of the aerosol generating device 1000. In detail, the controller 300 controls operation of other components included in the aerosol generating device 1000 as well as the battery 400 and the heater 500. Also, the controller 300 may determine whether or not the aerosol generating device 1000 is in an operable state by identifying a state of each of the components of the aerosol generating device 1000.

The controller 300 includes at least one processor. The processor may be implemented as an array of a plurality of logic gates, or may be implemented as a combination of a general-purpose microprocessor and a memory in which a program executable by the microprocessor is stored. In addition, one of ordinary skill in the art to which the present embodiment pertains may understand that the processor may be implemented in other forms of hardware.

The battery 400 supplies power used for the aerosol generating device 1000 to operate. For example, the battery 400 may supply power so that the heater 500 may perform heating, and may supply power needed for the controller 300 to operate.

Also, the battery 400 may supply power needed for the other components (e.g., the display and the sensor) of the aerosol generating device 1000 to operate.

The heater 500 may perform heating by power supplied from the battery 400, and the heater 500 that performs heating may increase the temperature of the aerosol generating article 100 accommodated in the accommodation portion of the housing 200.

When the aerosol generating article 100 is accommodated in or inserted into the housing 200, the aerosol generating device 1000 may generate an aerosol from the aerosol generating article 100 by operating the heater 500 via the controller 300. The aerosol generated from the aerosol generating article 100 may be supplied to a user via a mouthpiece portion 130.

In an embodiment, the heater 500 may be an electrical resistance heater. For example, the heater 500 may include an electrically conductive track, and the heater 500 may perform heating when currents flow through the electrically conductive track. However, the heater 500 is not limited to the example described above, and may include all heaters which may perform heating to a designated temperature. Here, the designated temperature may be preset in the aerosol generating device 1000, or may be set to a temperature wanted by the user.

For example, the heater 500 may include a tube-type heating element, a plate-type heating element, a needle-type heating element, or a rod-type heating element, and may heat the inside or the outside of the aerosol generating article 100, according to the shape of the heating element.

Also, the aerosol generating device 1000 may include a plurality of heaters 500. The plurality of heaters 500 may be arranged to be inserted into the aerosol generating article 100, or may be arranged outside the aerosol generating article 100. In another example, some of the plurality of heaters 500 may be arranged to be inserted into the aerosol generating article 100, and the others may be arranged outside the aerosol generating article 100.

In one or more embodiments, the heater 500 may be an induction heater. In detail, the heater 500 may include an electrically conductive coil that generates an alternating magnetic field to heat the aerosol generating article 100 in an induction heating method, and a susceptor heated by the alternating magnetic field.

Figure 6A:
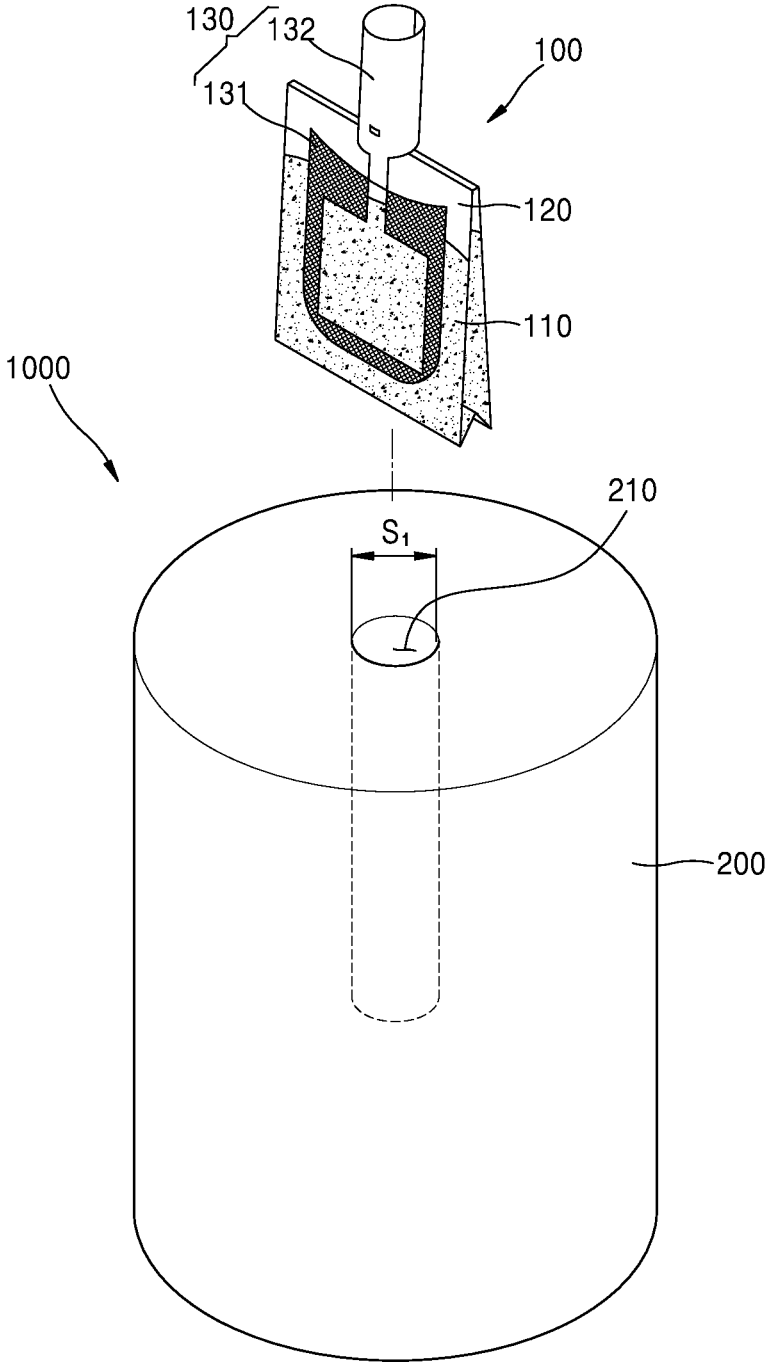
FIG. 6A is a view illustrating an aerosol generating device and an aerosol generating article, which are separated from each other, according to an embodiment.
Figure 6B:
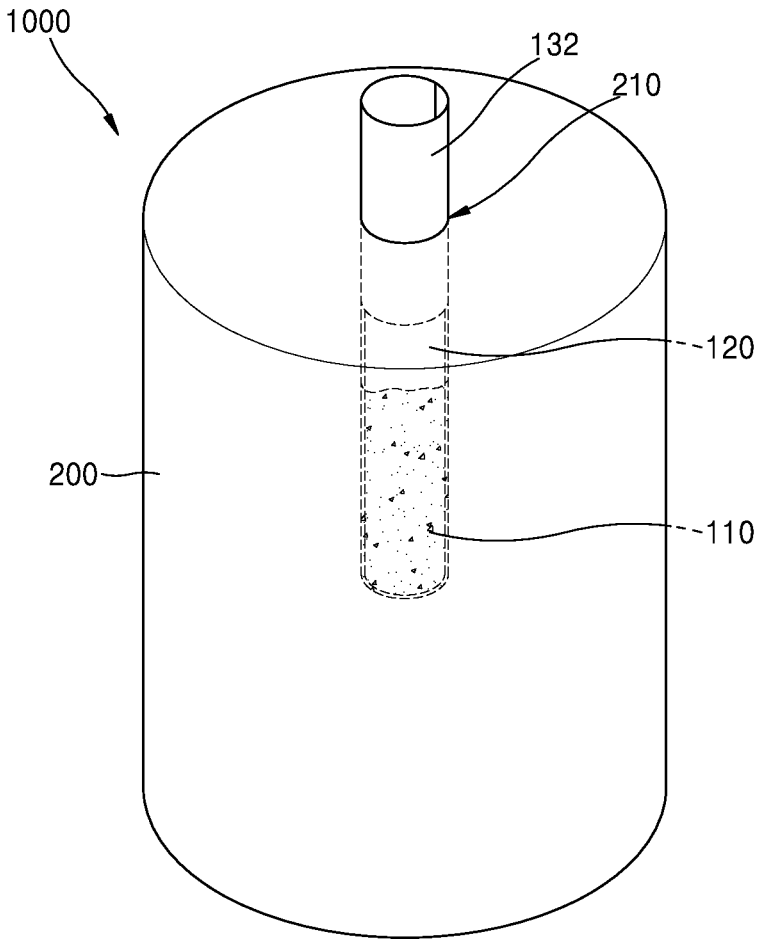
FIG. 6B is a view illustrating the aerosol generating device of FIG. 6A in which an aerosol generating article is accommodated.

FIG. 6A is a view illustrating an aerosol generating device and an aerosol generating article which are separated from each other, according to an embodiment. FIG. 6B is a view illustrating the aerosol generating device of FIG. 6A in which an aerosol generating article is accommodated. In detail, FIGS. 6A and 6B illustrate an example of the aerosol generating device 1000 shown in FIG. 5, and thus, a repeated description thereof will be omitted herein.

Referring to FIGS. 6A and 6B, an aerosol generating device 1000 according to an embodiment includes an accommodation portion 210 accommodating an aerosol generating article 100.

The accommodation portion 210 may be formed, for example, in at least one region of a housing 200, and at least a portion of the aerosol generating article 100 may be inserted into the accommodation portion 210 and accommodated inside the housing 200.

In an embodiment, the accommodation portion 210 may be formed to have a cross-sectional area S1 that is relatively smaller than a cross-sectional area of the aerosol generating article 100. In detail, the accommodation portion 210 may be formed to have the cross-sectional area S1 that is smaller than the cross-sectional area of the aerosol generating article 100, which is not inserted into the accommodation portion 210.

Due to the above-described structure, the aerosol generating article 100 may be fitted into the accommodation portion 210 of the aerosol generating device 1000. For example, the aerosol generating article 100 may be transformed in shape in a process of being inserted into the accommodation portion 210, and may be press-fitted into the accommodation portion 210, but is not limited thereto.

In addition, the accommodation portion 210 may fix a mouthpiece portion 130 of the aerosol generating article 100 that is inserted thereinto.

In an embodiment, a mouthpiece segment 132 of the aerosol generating article 100 may be transformed in shape to form a flow passage through which an aerosol generated by the aerosol generating article 100 may flow.

In detail, the mouthpiece segment 132 may pivot toward an upper end of the pouch 120, and then may be rolled such that one end of the mouthpiece segment 132 faces the other end facing the opposite direction to the one end, or at least a portion thereof may be bent, to form a flow passage.

For example, the mouthpiece segment 132 may form a cylindrical or elliptical columnar flow passage via the transformation described above, but is not limited thereto.

The accommodation portion 210 of the aerosol generating device 1000 according to the embodiment may accommodate at least some region (e.g., a lower region) of the mouthpiece segment 132 when the aerosol generating article 100 is accommodated therein, thereby fixing the transformed shape of the mouthpiece segment 132. For example, the accommodation portion 210 may accommodate about ⅓ of the mouthpiece segment 132 to fix the shape of the mouthpiece segment 132, but is not limited thereto.

At least one opening (e.g., the opening 133 of FIGS. 3A and 3B) may be formed in one region of the mouthpiece segment 132 exposed to the outside of the aerosol generating device 1000 while the aerosol generating article 100 is inserted into the accommodation portion 210.

External air may be introduced into a flow passage through the at least one opening described above, and accordingly, the inside of the flow passage overheated in a process of heating the aerosol generating article 100 may be cooled. Also, as the external air is introduced into the flow passage through the at least one opening, the external air may be mixed with an aerosol generated by the aerosol generating article 100, thereby increasing the user's smoking sensation or smoking impression.

FIGS. 6A and 6B illustrate only the embodiment in which the accommodation portion 210 is formed in a cylindrical shape, but the shape of the accommodation portion 210 is not limited to the illustrated shape.

Figure 7A:
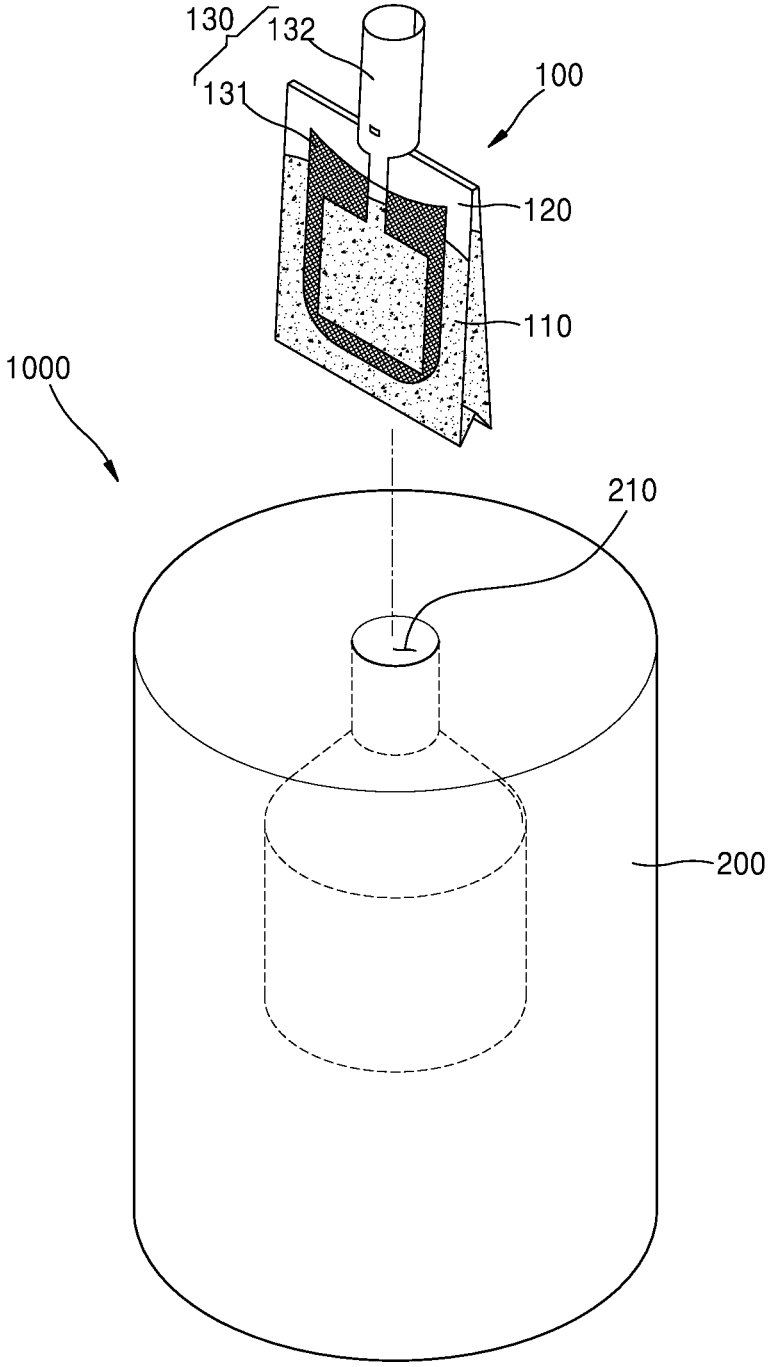
FIG. 7A is a view illustrating an aerosol generating device and an aerosol generating article, which are separated from each other, according to another embodiment.
Figure 7B:
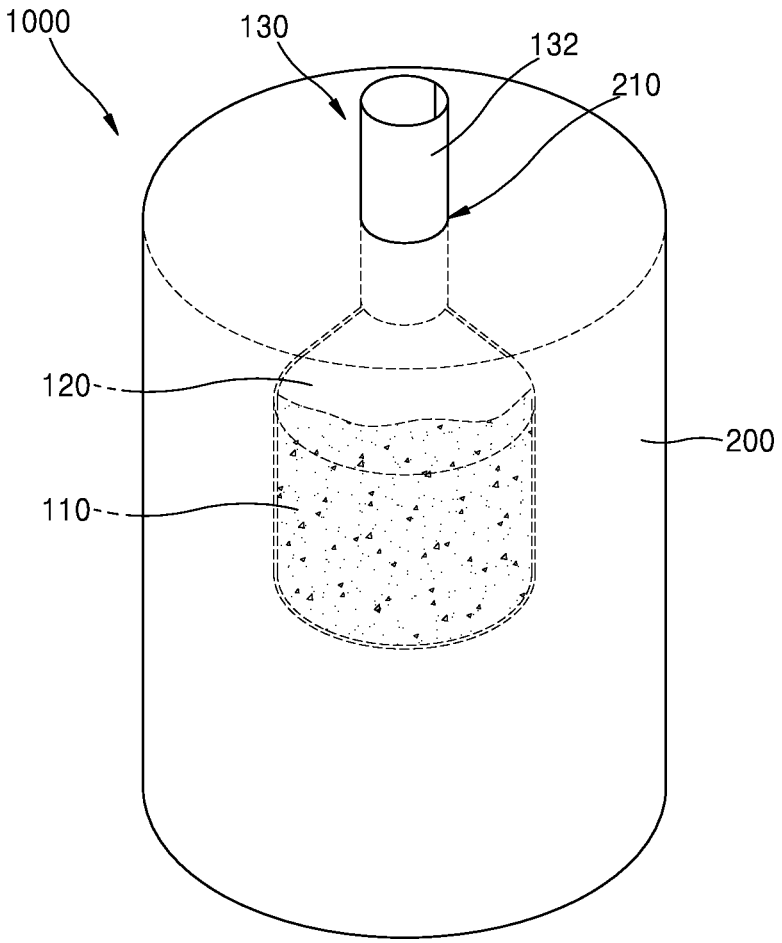
FIG. 7B is a view illustrating the aerosol generating device of FIG. 7A in which an aerosol generating article is accommodated.

FIG. 7A is a view illustrating an aerosol generating device and an aerosol generating article, which are separated from each other, according to another embodiment. FIG. 7B is a view illustrating the aerosol generating device of FIG. 7A in which an aerosol generating article is accommodated.

An aerosol generating device 1000 of FIGS. 7A and 7B may be an aerosol generating device 1000 obtained by transforming the shape of the accommodation portion 210 in the aerosol generating device 1000 of FIG. 6A, and thus, a repeated description thereof will be omitted herein.

Referring to FIGS. 7A and 7B, an accommodation portion 210 of the aerosol generating device 1000 according to another embodiment may be formed in a shape in which a cross-sectional area increases from one end open to the outside of the aerosol generating device 1000 toward the other end arranged toward the inside of the aerosol generating device 1000.

For example, the accommodation portion 210 may be formed such that the other end located in the opposite direction to the one end may have a cross-sectional area that is greater than a cross-sectional area of the open one end.

As the accommodation portion 210 is formed in a structure in which the cross-sectional area increases from the one end toward the other end, an area in which the aerosol generating article 100 inserted into the accommodation portion 210 is heated may relatively increase. For example, an area in which the aerosol generating article 100 inserted into the accommodation portion 210 overlaps a heater may extend, such that the area of the aerosol generating article 1000 that is heated may increase.

In other words, the aerosol generating device 1000 may increase, via the accommodation portion 210 described above, the heated area of the aerosol generating article 100 inserted into or accommodated in the accommodation portion 210. Accordingly, the aerosol generating device 1000 may reduce a time for which an aerosol is generated, and thus, a user's smoking convenience may be increased.

One of ordinary skill in the art related to the embodiments will understand that it may be implemented in a modified form without departing from the essential characteristics of the above description. Therefore, the disclosed methods should be considered in a descriptive sense only and not for purposes of limitation. The scope of the embodiments is indicated in claims, rather than in the above description, and all differences within an equivalent scope should be construed as being included in the embodiments.

The invention claimed is:

1. An aerosol generating article comprising:

a tobacco element;

a pouch configured to wrap the tobacco element, and discharge, to the outside, an aerosol generated by the aerosol generating article being heated, and a mouthpiece portion foldably coupled to the pouch, and configured to form a flow passage through which an aerosol generated by the aerosol generating article flows.

2. The aerosol generating article of claim 1, wherein the pouch includes a porous material.

3. The aerosol generating article of claim 2, wherein the porous material includes a cellulose material.

4. The aerosol generating article of claim 1, wherein the pouch is impregnated with a moisturizer of about 10 parts by weight to about 30 parts by weight with respect to 100 parts by weight of the tobacco element.

5. The aerosol generating article of claim 1, wherein the mouthpiece portion comprises:

an attachment segment attached to at least one region of the pouch; and a mouthpiece segment foldably attached to the pouch, and being transformable in shape to form the flow passage.

6. The aerosol generating article of claim 5, wherein the mouthpiece segment is foldable in a direction away from the attachment segment at a location where one end thereof is in contact with the attachment segment.

7. The aerosol generating article of claim 6, wherein the mouthpiece segment is transformed while being unfolded, to form the flow passage through which the aerosol generated by the aerosol generating article flows.

8. The aerosol generating article of claim 7, wherein the mouthpiece segment is rolled such that one end of the mouthpiece segment faces the other end facing the opposite direction to the one end.

9. The aerosol generating article of claim 7, wherein the mouthpiece segment is transformed into a cylindrical or polygonal columnar shape.

10. The aerosol generating article of claim 5, wherein the mouthpiece segment includes at least one opening through which air passes.

11. An aerosol generating device for heating an aerosol generating article comprising a tobacco element, a pouch wrapping the tobacco element, and impregnated with a moisturizer, and a mouthpiece portion foldably coupled to the pouch and forming a flow passage through which an aerosol generated by the aerosol generating article flows, the aerosol generating device comprising:

an accommodation portion configured to accommodate at least one region of the aerosol generating article; and a heater configured to heat the aerosol generating article accommodated in the accommodation portion.

12. The aerosol generating device of claim 11, wherein a cross-sectional area of the accommodation portion is smaller than a cross-sectional area of the aerosol generating article, and the aerosol generating article is fitted into the accommodation portion.

13. The aerosol generating device of claim 12, wherein the accommodation portion fixes the mouthpiece portion accommodated therein, coupled to the aerosol generating device.

14. The aerosol generating device of claim 11, wherein the accommodation portion has a cross-sectional area increasing from an open one end toward the other end arranged toward the inside of the aerosol generating device.

* * * * *